US006382472B1

(12) United States Patent
Shoval

(10) Patent No.: US 6,382,472 B1
(45) Date of Patent: May 7, 2002

(54) VISCOUS FLUID DISPENSER

(76) Inventor: Doron Shoval, Ha'achim 25, Holon (IL)

( * ) Notice: Subject to any disclaimer, the term of this patent is extended or adjusted under 35 U.S.C. 154(b) by 0 days.

(21) Appl. No.: 09/799,589

(22) Filed: Mar. 7, 2001

(51) Int. Cl.[7] ..... B67D 5/42
(52) U.S. Cl. ..... 222/387; 222/256; 222/260
(58) Field of Search ..... 222/256, 260, 222/386, 687

(56) References Cited

U.S. PATENT DOCUMENTS 1,717,672 A * 6/1929 Fitch ..... 222/387
2,666,555 A * 1/1954 Hill ..... 222/387
4,223,808 A * 9/1980 Williams et al. ..... 222/387
4,598,843 A * 7/1986 Foster et al. ..... 222/260
5,361,944 A * 11/1994 Hauf et al. ..... 222/256
5,788,124 A * 8/1998 Bougamont et al. ..... 222/260
6,244,475 B1 * 6/2001 Walz et al. ..... 222/387

* cited by examiner

*Primary Examiner*—J. Casimer Jacyna
(74) *Attorney, Agent, or Firm*—Mark M. Friedman

(57) ABSTRACT

A container-dispenser for products which are viscous fluids such as liquid soap, which allows one-handed operation to supply a controlled amount of viscous fluid in a convenient and clean way and protects the contents from exposure to air. The container body is equipped with a piston that applies constant pressure on the product within the container. By applying force on a valve from above, a passage is opened allowing the product to be dispensed through the top of the container. When the pressure on the valve is relieved, the opening is closed, preventing further dispensing of the product. Excess product is temporarily retained until needed in the "bowl" resulting from the convex shape of the top of the container.

9 Claims, 2 Drawing Sheets

VISCOUS FLUID DISPENSER

FIELD AND BACKGROUND OF THE INVENTION

The present invention relates to a dispenser of viscous fluids and, in particular, a container-dispenser that can be used with one hand to supply a controlled amount of viscous fluid in a convenient and clean way.

Many useful products are supplied as viscous fluids, commonly referred to as lotions, gels, greases, suspensions, creams, jellies, colloids, oils or salves. Such products include cosmetics, skin-care products, hygiene products such as fluid soap, or topical medications.

One method known in the art is to supply these products in wide-mouthed containers with lids, such as jars. Once the jar is open, the user can remove a required amount of product with the use of the fingers or aids such as cotton swabs and cotton balls. The disadvantages of jars are manifold. Throughout the time during which the product is in use it is exposed to the open air and light leading to drying out and other changes which comprise the desired properties of the product. Closing the jar after removal of an amount of product is inconvenient as opening and closing of the jar requires a relatively complex motion which cannot be done if one hand is occupied or if the hands are dirty. When repeated removal of the product from the jar is necessary, contamination may occur. For instance remnants of cosmetics on a cotton-ball when using cold cream for facial cosmetic removal may contaminate the product in the jar. The outside surface of the jar can get dirty from the product on the hands of the user. When the container is almost empty it is difficult to remove the last traces of the product for use. With certain products it is often difficult to remove the exact required amount.

In the art, a pump-action dispenser attached to the container holding the product is often used. This type of dispenser protects the product from light and from exposure to air, but often requires the use of two hands. Even in the best of cases, the use of one hand to bring the product onto an aid such a cotton-ball is difficult. Dripping from or the presence of dried product on the pump-spout often occurs. Often the last traces of the product are not removable from a container equipped with a pump-action dispenser.

In the art, it has been proposed to fix various types of container-dispensers to a wall or table, making one-handed dispensing convenient. However, it is often undesirable to impossible to fix a dispenser in one place.

There is therefore a need for a container-dispenser for viscous a fluid which overcomes the disadvantages of other container-dispensers known in the art.

SUMMARY OF THE INVENTION

The present invention is a container-dispenser which can be used with one hand to supply a controlled amount of viscous fluid in a convenient, easy to use way which protects the contents of the container-dispenser from exposure and contamination, and yet allows use of the entire contents of the container.

According to the teachings of the present invention there is provided a container-dispenser, for containing and dispensing a viscous fluid, made up of (a) a parallel-walled container body, formed with at least one wall defining a volume with an axis parallel to the wall, the container body having a top edge, (b) a piston configured to sealingly slide parallel to the axis within the container body, (c) a dispensing head with a top surface and a dispensing hole extending from the top surface through the dispensing head, the dispensing head connected to the top edge of the container body such that the wall or walls, the piston and the dispensing head together define a storage volume for the viscous fluid, the top surface of the dispensing head being inwardly hollowed, and (d) a normally-closed manually-operable valve mechanism associated with the dispensing hole so as to selectively block and unblock the dispensing hole to the passage of the viscous fluid.

According to a further feature of the present invention, a part of the valve mechanism protrudes from the dispensing hole and the valve mechanism is configured to unblock the dispensing hole when a downwards force is applied on that protruding part.

According to a further feature of the present invention, there is provided a valve mechanism made up of a plug configured to physically block the dispensing hole when the valve mechanism is in a closed state, the plug configured to partially protrude from the dispensing hold and a mechanism for biasing the plug to the closed state.

According to a further feature of the present invention, there is provided a container-dispenser wherein the container body is substantially cylindrical.

According to a further feature of the present invention, there is provided a dispensing head attached to the top edge of the container-body.

According to a further feature of the present invention, there is provided a dispensing head integrally formed with the top edge of the container-body.

According to a further feature of the present invention there is provided a pressure-applying mechanism configured to apply pressure to the bottom side of the piston.

According to a still further feature of the present invention the pressure-applying mechanism provided is a spring deployed so as to apply a force pushing the piston upwards within the container body.

According to a still further feature of the present invention, there is provided a foot operatively connected to the bottom side of the piston, the foot configured to stably support the container-dispenser on an underlying surface so that the container body and the dispensing head are at least partially supported by pressure within the viscous fluid.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a container-dispenser for viscous fluids. The principles and operation of container-dispensers according to the present invention may be better understood with reference to the drawings and the accompanying description.

Figure 1:
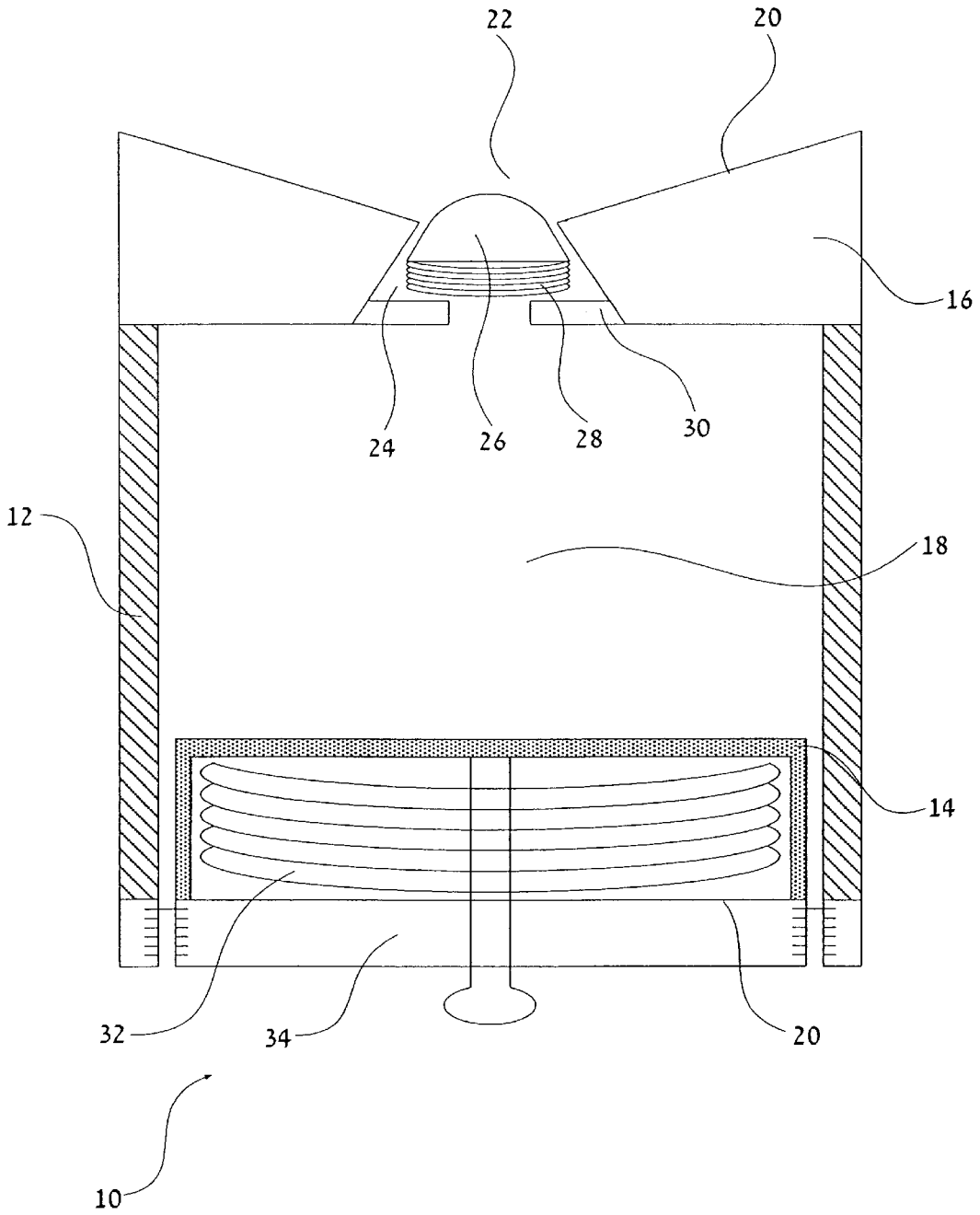
FIG. 1 is a schematic cross-section side view of a first embodiment of a container-dispenser, constructed and operative according to the teachings of the present invention.

First, a general description of a container-dispenser according to the present invention is made with reference to FIG. 1. Depicted in FIG. 1, is a parallel-walled container body 12. A piston 14 is configured to sealingly slide within container body 12. Connected to the top edge of container body 12 is a dispensing head 16 with an upper surface 20. There is a dispensing hole 24 extending from upper surface 20 through dispensing head 16. Upper surface 20 is inwardly hollow in form, that is to say, it forms a recess 22 wherein any excess of the dispensed product is temporarily retained until needed. It is to be understood that by inwardly hollow is meant a shape that effectively contains dispensed product at upper surface 20 such as a concave, a parabolic, a conical or other recessed shape. Deployed within dispensing hole 24 is a normally-closed manually-operable valve mechanism (elements 26, 28, and 30 taken together). By default the valve mechanism is in a closed state, blocking dispensing hole 24. When a force applied by a user actuates the valve mechanism, the valve mechanism is brought to an open state, unblocking dispensing hole 24 and allowing passage of product 18 out through dispensing hole 24 to be retained in recess 22.

It is clear to one skilled in the art that various different types of valve mechanisms can be used in the present invention. By way of example, two specific types of valve mechanisms are described in the following descriptions.

Referring now to a specific embodiment of present invention, FIG. 1 shows a first embodiment of a container-dispenser according to the present invention, generally designated 10. Generally speaking, container-dispenser 10 is composed of three parts, container body 12, piston 14 and dispensing head 16. Container body 12 has the shape of a hollow tube, being preferably cylindrical. Piston 14 fits inside container body 12 and is configured to sealingly slide upwards and downwards within container body 12. In the embodiment of the present invention depicted in FIG. 1, dispensing head 16 is non-removably attached or integrally formed with the top edge of container body 12. Pressure applied to the bottom surface 20 of piston 14 applies pressure on product 18. As long as the valve mechanism is not open, dispensing hole 24 is blocked and product 18 is contained within the volume delineated by container body 12, piston 14 and dispensing head 16.

In the embodiment of the present invention shown in FIG. 1, a dispensing spring 32 is provided to provide an upward force on piston 14. Dispensing spring 32 acts against bottom plate 34 that is removably attached to container body 12 by threading. To prevent leakage from between container body 12 and the edges of piston 14, piston 14 slides sealingly in container body 12, that is to say piston 14 is further configured so as to prevent such leakage. This can be done by producing piston 14 of a material and to such a tolerance that product 18 cannot escape, or through the addition of a separate seal (not appearing in FIG. 1).

The valve-mechanism is configured as to allow one-handed control of the amount of product dispensed and upper surface 20 of dispensing head 16 is configured to provide a containment volume for the dispensed product. In the embodiment of the present invention shown in FIG. 1, the dispensing of product 18 through cone-shaped dispensing hole 24 is effected by the valve mechanism, made up of a plug with a parabolic cross-section 26, a spring 28, and a counter-force ledge 30.

Plug 26 is configured so that when placed with its narrow tip through dispensing hole 24, plug 26 protrudes to some extent but cannot pass completely through dispensing hole 24. The outer surface of plug 26 and the internal surface of dispensing hole 24 are so configured that when in place in a closed state plug 26 blocks dispensing hole 24 preventing escape of product 18 through dispensing hole 24, even when product 18 is under pressure applied by piston 14. Furthermore, plug 26 substantially prevents the entrance of air or other undesirable materials and prevents evaporation of solvent or drying out of product 18 contained within container-dispenser 10.

Counter-force ledge 30 is operatively connected to dispensing head 16 so as to be fixed in place and so as not to obstruct the flow of product 18 through dispensing hole 24. Spring 28 is placed between plug 26 and counter-force ledge 30 in such a way as to exert a force separating counter-force ledge 30 from plug 26. Because counter-force ledge 30 is fixed in place, plug 26 is forced upwards, blocking dispensing hole 24, and preventing escape of product 18 through dispensing hole 24, even when product 18 is under pressure applied by piston 14.

The valve mechanism of dispensing head 16 is activated by a force applied by the user to the part of plug 26 protruding thorough dispensing hole 24. The force applied by the user depresses plug 26 downwards, compressing spring 28 and opening a passage through which product 18 can flow outwards, past counter-force ledge 30, through dispensing hole 24 to accumulate on the upper surface 20 of dispensing head 16. When the desired amount of product 18 has accumulated, the user stops applying pressure on plug 26. Spring 28 pushes plug 26 upwards, causing plug 26 to block dispensing hole 24. Further undesired escape of product 18 through dispensing hole 24 is prevented.

As it escapes through dispensing hole 24, product 18 can be used as desired. In FIG. 1, upper surface 20 of dispensing head 16 is concave in form. Product 18 escapes through dispensing hole 24 to be used, whereas excess product is temporarily retained within recess 22 produced by this concave form, which serves as a "bowl". Excess escaped product 18 retained in "bowl" 22 is used as desired. If too much product is dispensed or the product that is accumulated in the bowl becomes contaminated, the unused product can be easily removed.

Figure 2:
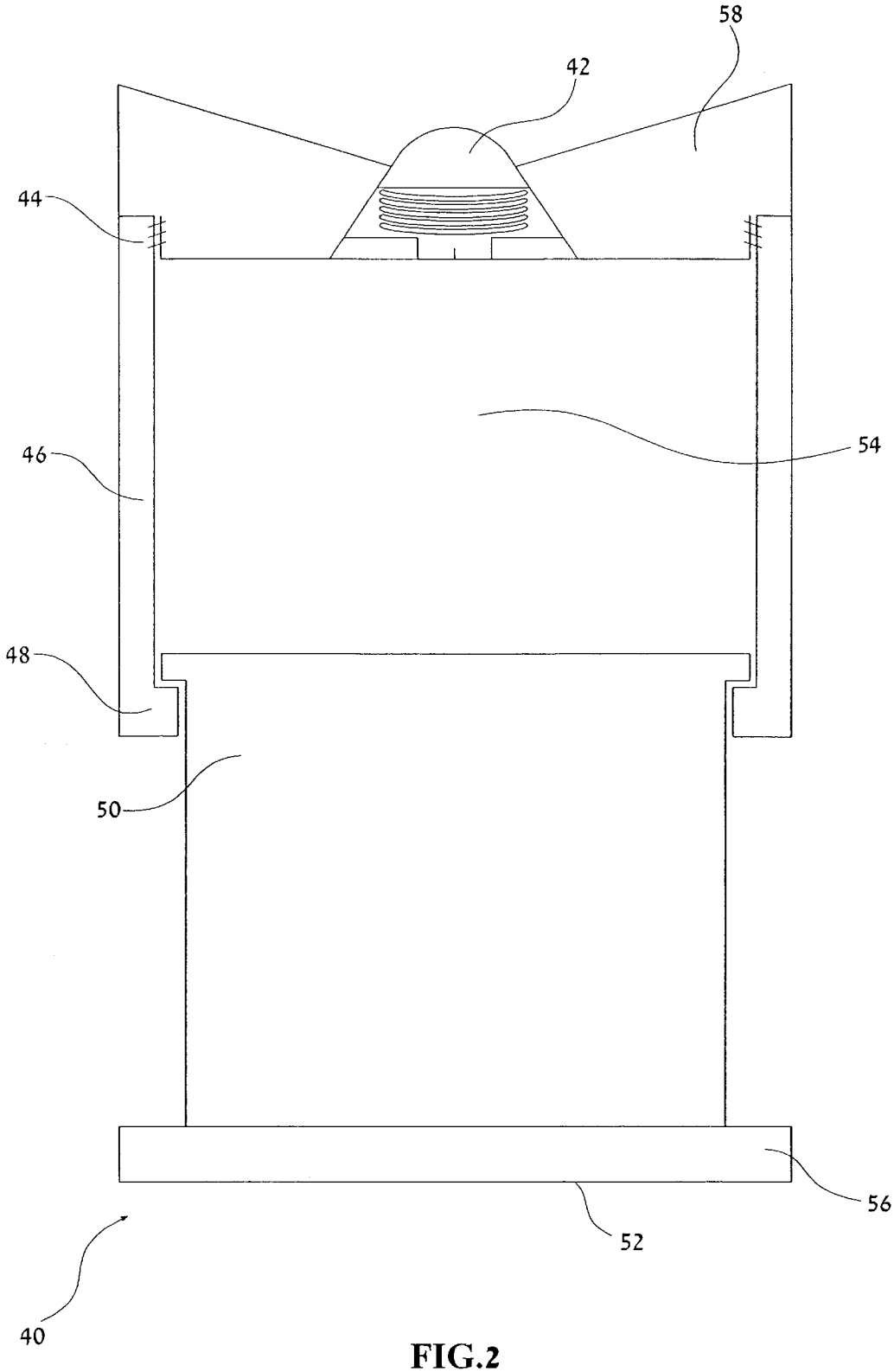
FIG. 2 is a schematic cross-section side view of a second embodiment of a container-dispenser, constructed and operative according to the teachings of the present invention.

An additional embodiment of the container-dispenser of the present invention is depicted in FIG. 2. Salient differences between the embodiment of the present invention depicted in FIG. 1 and that depicted in FIG. 2, generally designated 40, include a plug 42 with a substantially conical cross-section and a removably attached dispensing head 58. Attachment of dispensing head 58 to container body 46 is done with the aid of threads 44. Furthermore, container body 46 is provided with a ledge 48 around at least part of its bottom edge. Ledge 48 is configured so as to engage piston 50 in such a way so that piston 50 cannot fall out in a downwards direction from container body 46. Piston 50 is configured with a foot 56 that allows container-dispenser 40 to stand on foot 56 in a stable fashion.

The upwards force that pushes product 54 outwards in the embodiment of the present invention depicted in FIG. 2 is generated by the force applied by the user when pressing plug 42 downwards, as well as by the weight of container body 46 and dispensing head 58.

Because dispensing head 58 is removably attached to container body 46, it is possible to refill container-dispenser 40 if product 54 is used up. This is done by unscrewing dispensing head 58 from container-dispenser 40, extending piston 50 outwards so that it makes contact with ledge 48, pouring more product 54 into the volume defined by container body 46 and piston 50, and subsequently reattaching dispensing head 58.

The operation of the embodiment of the present invention depicted in FIG. 2 is otherwise analogous to that described before and is clear to one skilled in the art. Therefore, further details of the use of the embodiment of the present invention depicted in FIG. 2 are not provided.

It will be appreciated that the above descriptions are intended only to serve as examples, and that many other embodiments are possible within the spirit and the scope of the present invention.

What is claimed is:

1. A container-dispenser for containing and dispensing a viscous fluid comprising:

a) a parallel-walled container body, formed with at least one wall defining a volume with an axis parallel to said at least one wall, said container body having a top edge;

b) a piston configured to sealingly slide parallel to said axis within said container body;

c) a dispensing head with a top surface and a dispensing hole extending from said top surface through said dispensing head, said dispensing head connected to said top edge of said container body such that said at least one wall, said piston and said dispensing head together define a storage volume for the viscous fluid, said top surface of said dispensing head being inwardly hollowed; and d) a normally-closed manually-operable valve mechanism associated with said dispensing hole so as to selectively block and unblock said dispensing hole wherein said dispensing hole is configured to dispense the viscous fluid onto said top surface for the temporary retention and storage of the viscous fluid until needed by a user.

2. The container-dispenser of claim 1 wherein a part of said valve mechanism protrudes from said dispensing hole and said valve mechanism is configured to open by application of a downwards force on said part.

3. The container-dispenser of claim 2 wherein said valve mechanism includes:

i) a plug configured to physically block said dispensing hole when said valve mechanism is in a closed state, said protruding part being provided by a portion of said plug; and ii) a mechanism for biasing said valve mechanism to said closed state.

4. The container-dispenser of claim 1 wherein said container body is substantially cylindrical.

5. The container-dispenser of claim 1 wherein said dispensing head is attached to said top edge of said container body.

6. The container-dispenser of claim 1 wherein said dispensing head is integrally formed with said top edge of said container body.

7. The container dispenser of claim 1 further comprising a pressure-applying mechanism configured to apply pressure to a bottom side of said piston.

8. The container-dispenser of claim 7 wherein said pressure-applying mechanism includes a spring deployed to apply a force pushing said piston upwards within said container body.

9. The container-dispenser of claim 1 further comprising:

e) a foot operatively connected to a bottom side of said piston, said foot configured to stably support the container-dispenser on an underlying surface such that said container body and said dispensing head are supported at least in part by pressure within the viscous fluid.

* * * * *